US006325405B2

(12) United States Patent
Okajima

(10) Patent No.: US 6,325,405 B2
(45) Date of Patent: Dec. 4, 2001

(54) ACTIVE HIGHBACK SYSTEM FOR A SNOWBOARD BOOT

(75) Inventor: Shinpei Okajima, Izumi (JP)

(73) Assignee: Shimano Inc., Osaka (JP)

( * ) Notice: Subject to any disclaimer, the term of this patent is extended or adjusted under 35 U.S.C. 154(b) by 0 days.

(21) Appl. No.: 09/781,401

(22) Filed: Feb. 13, 2001

Related U.S. Application Data

(62) Division of application No. 09/261,487, filed on Mar. 3, 1999, now Pat. No. 6,231,066.

(51) Int. Cl.[7] ..... A63C 9/20

(52) U.S. Cl. ..... 280/623; 280/611; 280/624; 280/14.2

(58) Field of Search ..... 280/14.2, 618, 280/607, 630, 811, 816, 826, 611, 601, 610, 616, 617, 623, 624, 633, 635, 609; 36/118.8, 118.2, 118.3, 115, 118.5, 118.7, 119.1, 117.4

(56) References Cited

U.S. PATENT DOCUMENTS

| | | | | |
|---|---|---|---|---|
| 3,696,534 | | 10/1972 | Hornung . | |
| 3,854,743 | | 12/1974 | Hansen . | |
| 4,501,078 | | 2/1985 | Kopp . | |
| 4,880,251 | * | 11/1989 | Wulf et al. | 280/613 |
| 4,934,075 | | 6/1990 | Benetti et al. . | |
| 5,152,085 | | 10/1992 | Baggio et al. . | |
| 5,203,098 | * | 4/1993 | Perrissoud et al. | 36/117 |
| 5,435,080 | | 7/1995 | Meiselman | 36/117 |
| 5,457,899 | | 10/1995 | Chemello . | |
| 5,461,802 | | 10/1995 | Paris et al. . | |
| 5,493,793 | | 2/1996 | Pozzobon et al. . | |
| 5,553,402 | | 9/1996 | Marega et al. . | |
| 5,556,123 | | 9/1996 | Fournier . | |

(List continued on next page.)

FOREIGN PATENT DOCUMENTS

| | | | |
|---|---|---|---|
| 0 772 982 A2 | | 5/1997 | (EP) . |
| 0 793 920 A1 | | 9/1997 | (EP) . |
| 0 820 789 A1 | | 1/1998 | (EP) . |
| 0 847 706 A2 | | 6/1998 | (EP) . |
| 0 916 271 A2 | | 5/1999 | (EP) . |
| 10-117803 | | 5/1998 | (JP) . |
| 2792677 B2 | | 6/1998 | (JP) . |
| 3051709 | | 6/1998 | (JP) . |
| 2807432 B2 | | 7/1998 | (JP) . |
| WO 97/35494 A1 | | 10/1997 | (WO) . |
| WO 98/31247-A1 | * | 7/1998 | (WO) . |
| WO 98/47398 A1 | | 10/1998 | (WO) . |

*Primary Examiner*—J. J. Swann
*Assistant Examiner*—J. Allen Shriver
(74) *Attorney, Agent, or Firm*—Shinjyu Global IP Counselors, LLP

(57) ABSTRACT

An active high back system is provided for automatically adjusting the snowboard boot between a walking position and a riding position. The snowboard boot is provided with an active highback support that is adjustably mounted to a snowboard boot. During walking, the active highback support does not constrain the flexibility of the snowboard boot making it possible for the snowboard rider to walk easily. When the rider steps into the bindings of the snowboard, the active highback support engages a part of the snowboard or binding that causes the snowboard boot to lean forward. In other words, the highback support is positioned to engage the back leg portion of a snowboard boot to provide a rigid surface that holds the boot in a forward leaning position. The active highback support is provided with an adjustment mechanism that allows the rider to adjust the amount of forward lean when the snowboard boot is engaged within the bindings of the snow board.

13 Claims, 9 Drawing Sheets

U.S. PATENT DOCUMENTS

| | | | | |
|---|---|---|---|---|
| 5,647,148 | | 7/1997 | Meiselman . | |
| 5,664,344 | | 9/1997 | Marmonier . | |
| 5,690,351 | | 11/1997 | Karol . | |
| 5,718,066 | | 2/1998 | Chemello et al. . | |
| 5,720,119 | | 2/1998 | Benoit . | |
| 5,771,609 | | 6/1998 | Messmer . | |
| 5,784,810 | | 7/1998 | Bonaventure . | |
| 5,819,441 | | 10/1998 | Perrissoud . | |
| 5,832,635 | * | 11/1998 | Finney et al. | 36/118.8 |
| 5,857,271 | | 1/1999 | Pallatin . | |
| 5,901,971 | * | 5/1999 | Eaton | 280/14.2 |
| 5,909,885 | | 6/1999 | Borel . | |
| 5,915,821 | * | 6/1999 | Okajima et al. | 36/117.1 |
| 5,941,554 | | 8/1999 | Bourdeau . | |
| 5,967,531 | * | 10/1999 | Sailet | 280/11.36 |
| 5,975,555 | | 11/1999 | Snoke et al. . | |
| 5,975,557 | | 11/1999 | Snoke et al. . | |
| 5,979,082 | * | 11/1999 | Pallatin | 36/118.2 |
| 6,012,237 | | 1/2000 | Okajima et al. . | |
| 6,027,136 | | 2/2000 | Phillips . | |
| 6,082,026 | * | 7/2000 | Sand et al. | 36/89 |
| 6,101,745 | * | 8/2000 | Grandin et al. | 36/118.7 |
| 6,155,577 | * | 12/2000 | Okajima | 280/14.2 |
| 6,231,057 | * | 5/2001 | Reuss et al. | 280/14.21 |
| 6,231,066 | * | 5/2001 | Okajima | 280/623 |

* cited by examiner

ACTIVE HIGHBACK SYSTEM FOR A SNOWBOARD BOOT

CROSS-REFERENCE TO RELATED APPLICATION

This application is a divisional application of U.S. patent application Ser. No. 09/261,487, filed Mar. 3, 1999, now U.S. Pat. No. 6,231,066.

BACKGROUND OF THE INVENTION

1. Field of the Invention

This invention generally relates to a snowboard boot with a highback support. More specifically, the present invention relates to a snowboard boot with a highback support that is easily adjustable.

2. Background Information

In recent years, snowboarding has become a very popular winter sport. In fact, snowboarding was also an Olympic event during the winter games at Nagano, Japan. Snowboarding is similar to skiing in that a rider rides down a snow covered hill. The snowboard is generally shaped as a small surfboard or a large skateboard without wheels. The snowboarder stands on the snowboard with his or her feet generally transverse to the longitudinal axis of the snowboard. Similar to skiing, the snowboarder wears special boots, which are fixedly secured to the snowboard by a binding mechanism. In other words, unlike skiing, the snowboarder has both feet securely attached to a single snowboard with one foot positioned in front of the other foot. The snowboarder stands with both feet on the snowboard in a direction generally transverse to the longitudinal axis of the snowboard. Moreover, unlike skiing, the snowboarder does not utilize poles.

Snowboarding is a sport that involves balance and control of movement. When steering on a downhill slope, the snowboarder leans in various directions in order to control the direction of the movement of the snowboard. Specifically, as the snowboarder leans, his or her movements must be transmitted from the boots worn by the rider to the snowboard in order to maintain control of the snowboard. For example, when a snowboarder leans backward, the movement causes the snowboard to tilt accordingly turning in the direction of the lean. Similarly leaning forward causes the board to tilt in a corresponding manner and thus causing the snowboard to turn in that direction.

Generally, the sport may be divided into alpine and freestyle snowboarding. In alpine snowboarding, hard boots similar to those conventionally used for alpine skiing are worn, and fitted into so-called hard bindings mounted on the snowboard, which resemble alpine ski boot bindings. In freestyle snowboarding, soft boots similar to ordinary boots, or adaptations of such boots as distinct from hard shell alpine boots are typically worn, fitted into so-called soft bindings.

Boots that are used for, for instance, skiing and/or snowboarding must have a high degree of rigidity for effecting steering while skiing and snowboarding. In particular, when snowboarding it is important that the rider be able to lean to the side, back and forward with respect to the snowboard. The motion corresponding to the direction of the lean of the rider is transmitted through the boots to the snowboard (or skis) to effect turning or braking. Therefore, it is extremely important that the boots worn by the rider have sufficient rigidity to transfer such leaning motion to the snowboard or skis.

In particular, the back side of a snowboard boot must be rigid in order to provide the appropriate support for controlling movement of the snowboard. Further, as the art of snowboarding has developed, riders have found that snowboard boots provide optimal support when the back side of the snowboard boots are inclined slightly, such that the knees of the rider are always slightly bent when wearing the boots on level ground. Therefore, standing up straight with knees straight when wearing inclined snowboard boots is not always comfortable. Further, walking in such snowboard boots is sometimes awkward.

Recently, snowboard boots have been developed which allow a rider to adjust and change the inclination of inclined backside snowboard boots. For example, there are snowboard boots which include a member known as a highback support that is secured to the snowboard boot by pins which allow the highback support to pivot about the pins. The highback support extends up the back side of the boot and when locked into position fixes the back side of the boot into a predetermined inclined position that is optimal for snowboarding. When unlocked, the highback support can pivot back and allow the rider wearing the boot to stand up straight and walk more freely without having to keep the knees bent. A simple bar is used with such a boot for locking the highback support in place. Typically, the bar braces the highback support into position. An upper end of the bar is fixed to an upper portion of the highback support by a pivot pin. A lower end of the bar is configured to fit into a hook formed in a lower portion of the boot. When a rider is wearing the boots, the rider must lean forward in order to fit the bar into and out of position. The lean forward requires a significant amount of effort due to the overall rigidity of the snowboard boots and therefore the bar configuration, especially in the snow and cold can be difficult for some riders to release and/or engage.

In view of the above, there exists a need for an improved highback system, which automatically moves from a walking position to a riding position when coupled to the binding. This invention addresses this need in the prior art as well as other needs, which will become apparent to those skilled in the art from this disclosure.

SUMMARY OF THE INVENTION

One object of the present invention is to provide a highback system that automatically moves from a walking position to a riding position when coupled to the binding.

Another object of the present invention is to provide a highback system that can be easily adjusted from a first leaning position to a second steeper leaning position without tools.

Another object of the present invention is to provide a highback support of a snowboard boot with an adjusting mechanism that is easy to manipulate.

Another object of the present invention is to provide a highback support for a snowboard boot with a reliable adjusting mechanism for controlling the amount of lean by the highback support.

In accordance with one aspect of the present invention, a snowboard boot is provided with an active highback system. The snowboard boot has a boot body with a sole portion, a toe portion, a heel portion and a leg portion. The leg portion is constructed of a flexible first material. The active highback system has a highback support movably coupled to the boot body to apply a bending force to the leg portion in a direction generally extending from the heel portion towards the toe portion. The active highback support includes a substantially rigid support member, a coupling member coupled to the support member and an adjusting mechanism. The support member engages the leg portion to apply the bending force to the leg portion. The coupling member is coupled to the support member and adapted to engage a complimentary coupling member that is separate from the snowboard boot to automatically move the support member to apply the bending force to the leg portion when engaged therewith. The adjusting mechanism is coupled between the support member and the leg portion to vary the bending force applied to the leg portion by the support member.

Preferably, an activating member is coupled to the binding and the support member is configured to be permanently fixed to a portion of a snowboard boot.

These and other objects, features, aspects and advantages of the present invention will become apparent to those skilled in the art from the following detailed description, which, taken in conjunction with the annexed drawings, discloses preferred embodiments of the present invention,

BRIEF DESCRIPTION OF THE DRAWINGS

Referring now to the attached drawings which form a part of this original disclosure.

DETAILED DESCRIPTION OF THE PREFERRED EMBODIMENTS

Figure 1:
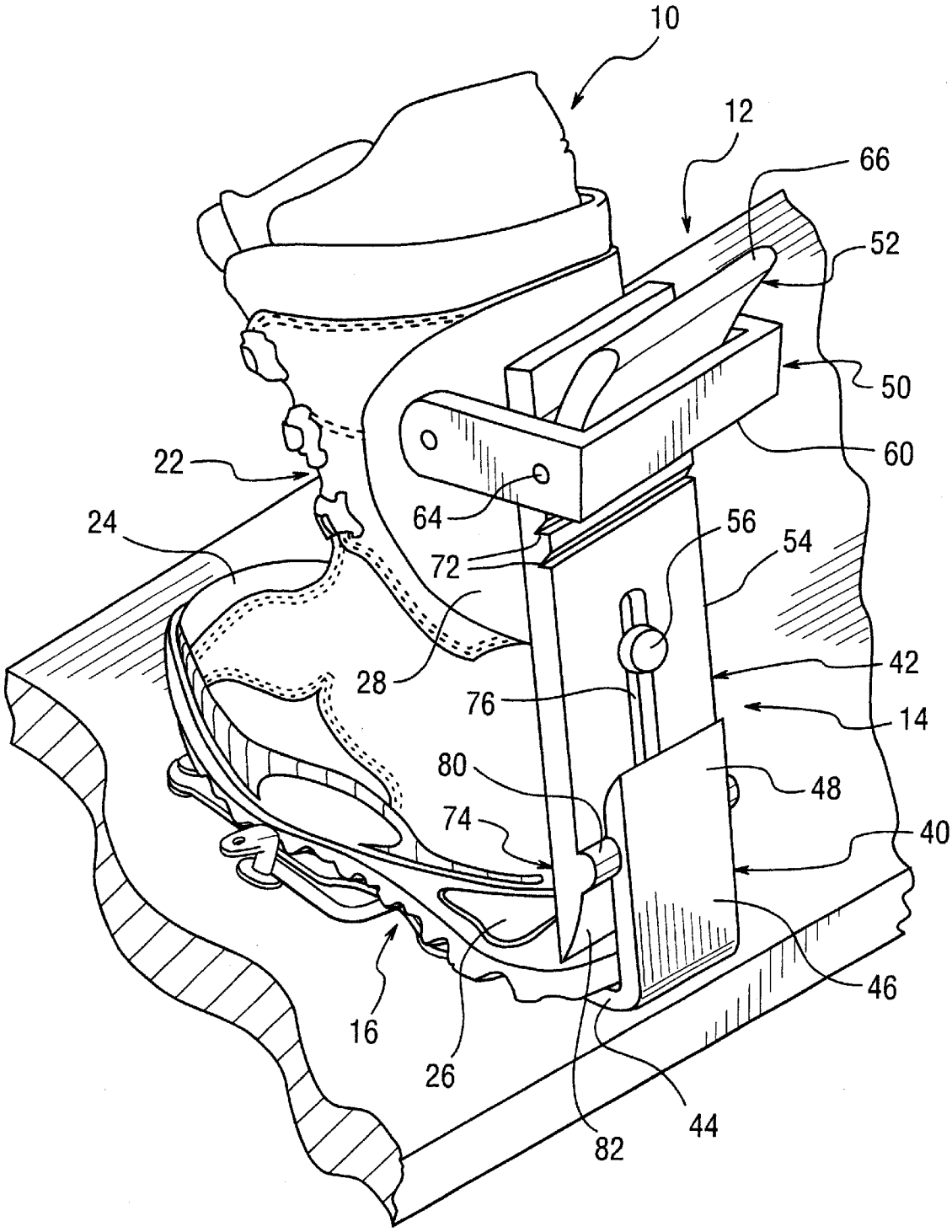
FIG. 1 is a rear perspective view of a snowboard boot mounted on a snowboard with an active highback system in accordance with one embodiment of the present invention coupled therebetween.
Figure 2:
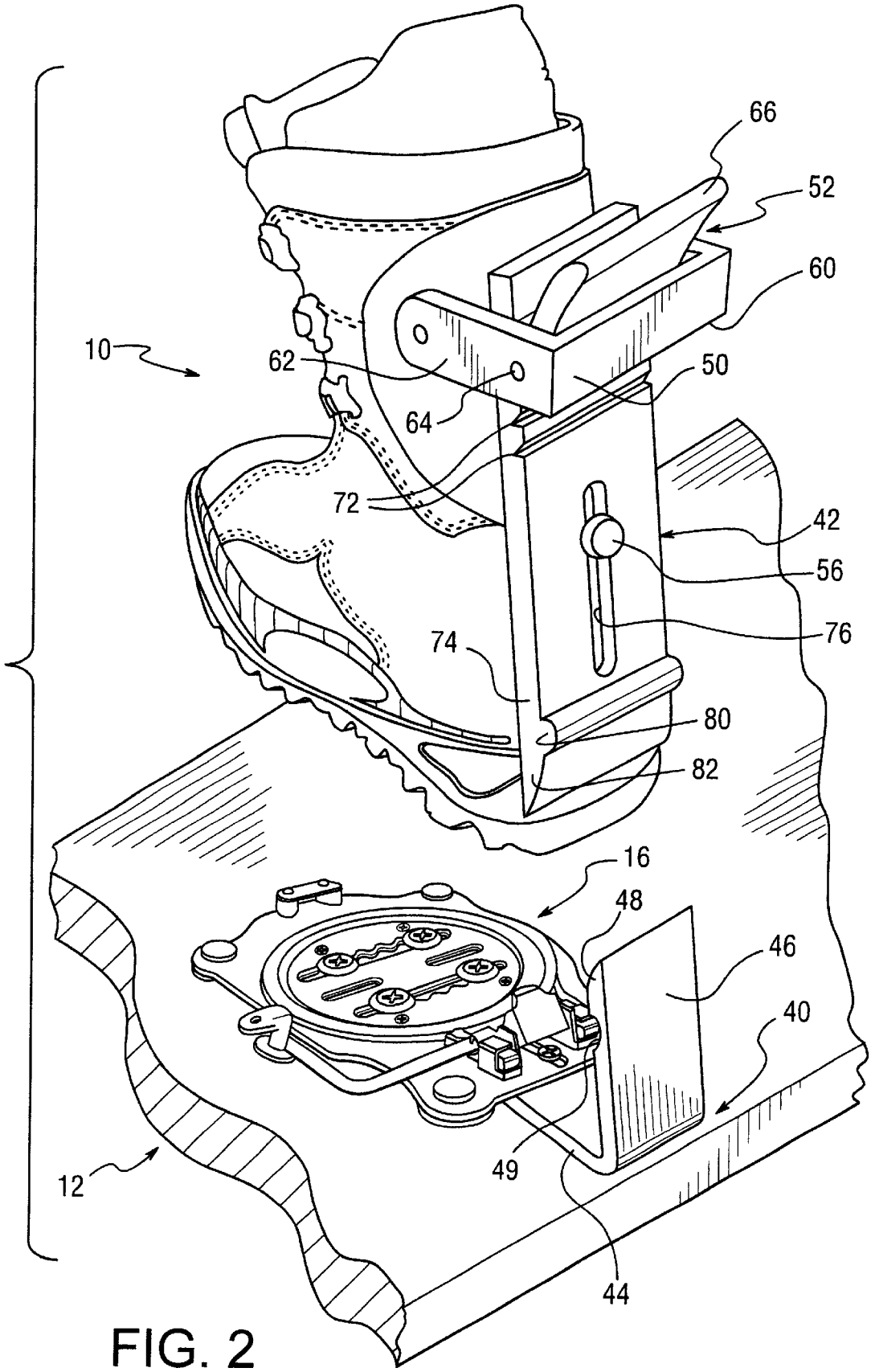
FIG. 2 is an exploded rear perspective view of the snowboard boot and the snowboard illustrated in FIG. 1 with the active highback system of the present invention coupled thereto.
Figure 3:
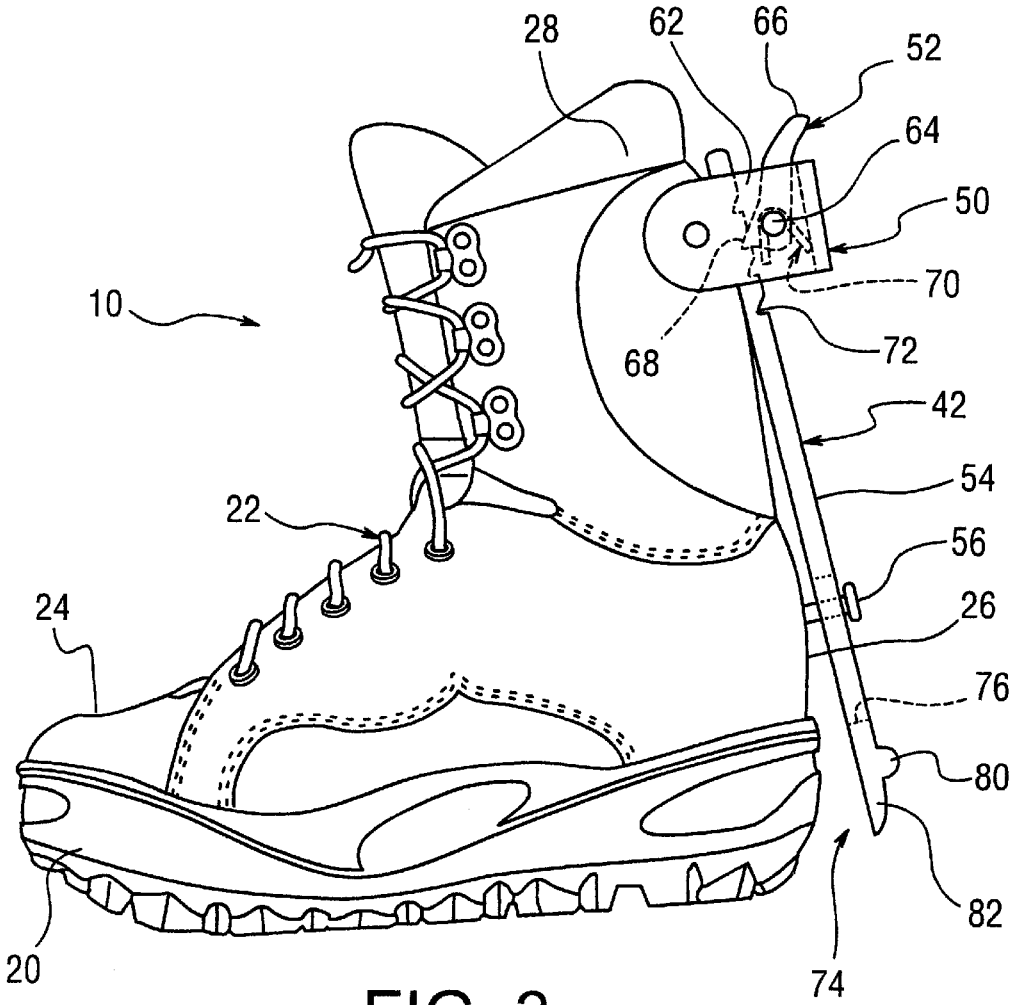
FIG. 3 is a side elevational view of the snowboard boot illustrated in FIGS. 1 and 2 in a walking position.

Initially referring to FIGS. 1 and 2, a snowboard boot 10 is illustrated as being attached to a snowboard 12 with an active highback system 14 coupled therebetween in accordance with one embodiment of the present invention. Active highback system 14 is designed to allow the snowboard boot 10 to be automatically adjusted from a walking position to a riding position upon snowboard boot 10 being attached to snowboard 12. More specifically, active highback system 14 does not constrain the flexibility of snowboard boot 10 making it possible for the snowboard rider to walk easily when the snowboard boot 10 is not coupled to snowboard 12. When the rider steps into the binding 16 of the snowboard 12, the active highback system 14 automatically causes the snowboard boot 10 to lean forward. In other words, the active highback system 14 engages the rear of the snowboard boot 10 to provide a rigid surface that holds the snowboard boot 10 in a forward lean position. Moreover, active highback system 14 allows the rider to automatically increase the amount of forward lean of the snowboard boot 10 by merely leaning forward.

Snowboard boot 10 basically includes a sole portion 20 and an upper portion 22 that are fixedly coupled together. Typically, the sole portion 20 is made of a stiff rubber-like material. The upper portion 22, on the other hand, can be made from a variety of materials such as plastic materials, leather and/or synthetic leather materials. Upper portion 22 should be somewhat flexible so that active highback system 14 can apply a forward leaning force thereto. Upper portion 22 basically includes a toe portion 24, a heel portion 26 and a leg portion 28. These three portions 24, 26 and 28 form a boot body that is coupled to sole portion 20.

Figure 4:
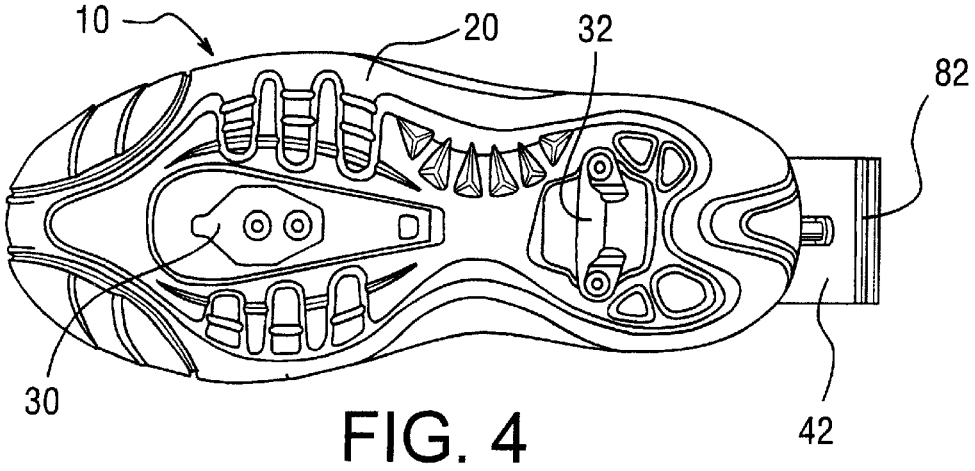
FIG. 4 is a bottom plan view of the snowboard boot illustrated in FIGS. 1–3.

As seen in FIG. 4, sole portion 20 is preferably provided with a front cleat or engagement member 30 and a rear cleat or engagement member 32. Cleats 30 and 32 are configured for engagement with binding 16 that is fixedly coupled to snowboard 12 in a conventional manner. The binding 16 and cleats 30 and 32 of the illustrated embodiment are of the type known as a CLICKER™ mechanism manufactured by Shimano Inc. of Osaka, Japan. Of course, it will be apparent to those skilled in the art from this disclosure that other types of bindings can be utilized for attaching snowboard boot 10 to snowboard 12. Since the particular structure of binding 16 is not critical to the present invention, binding 16 and its cleats 30 and 32 will not be discussed or illustrated in detail herein.

Figure 5:
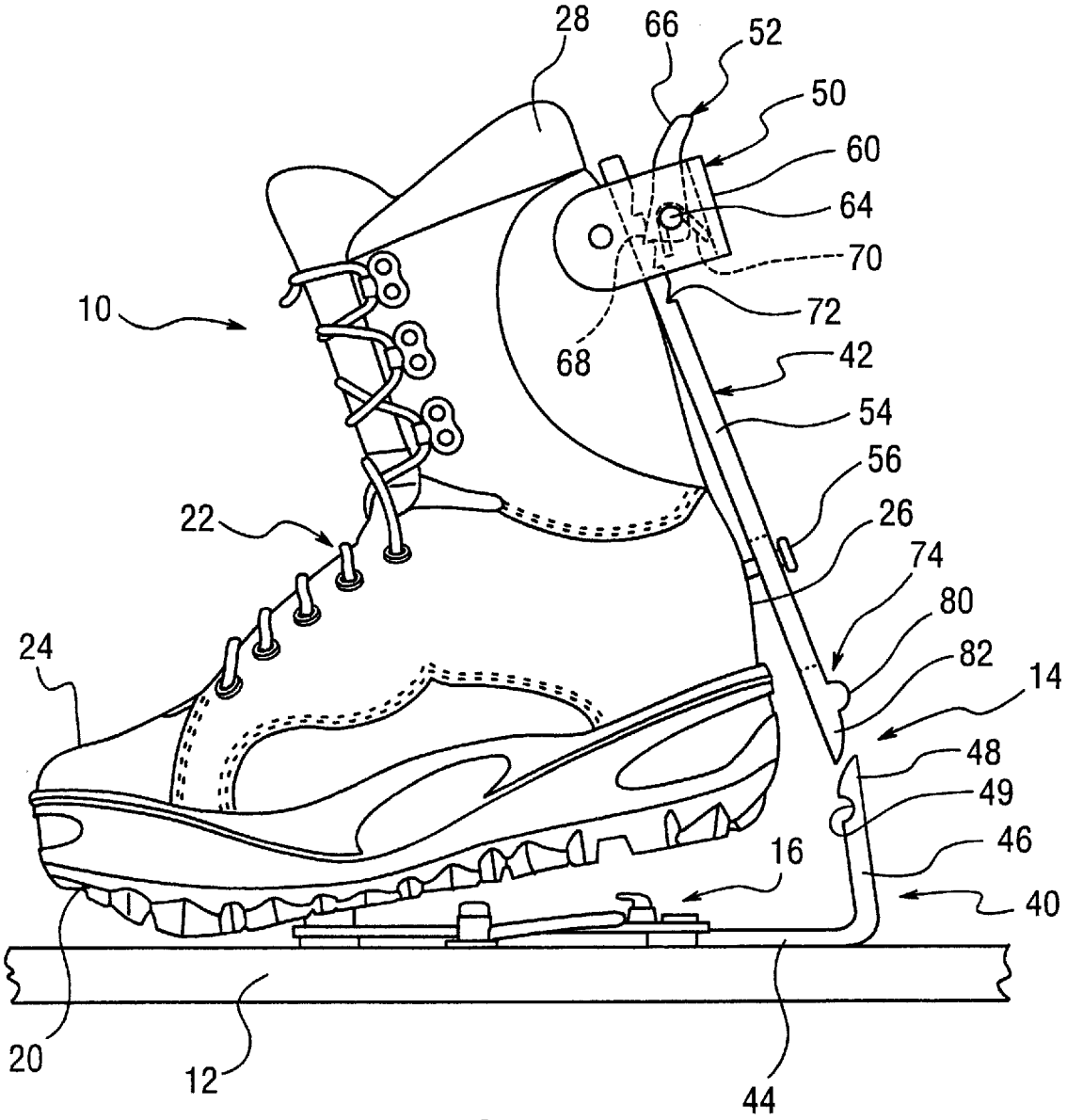
FIG. 5 is a side elevational view of the snowboard boot being partially engaged with the snowboard binding of the snowboard in accordance with the present invention.
Figure 6:
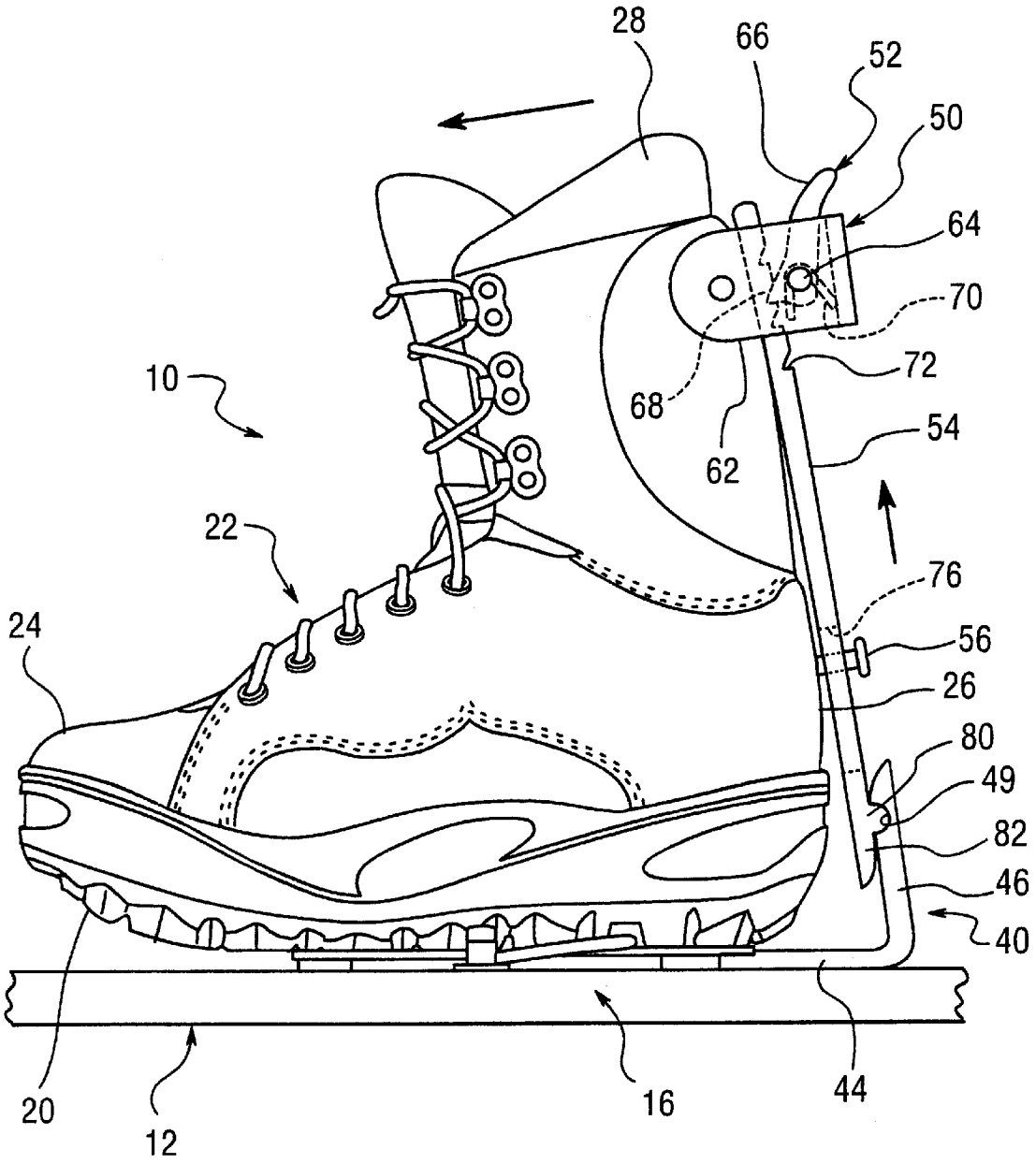
FIG. 6 is a side elevational view of the snowboard boot and snowboard illustrated in FIGS. 1, 2 and 5 with the active highback system of the present invention bending the snowboard boot to a forward lean position.
Figure 7:
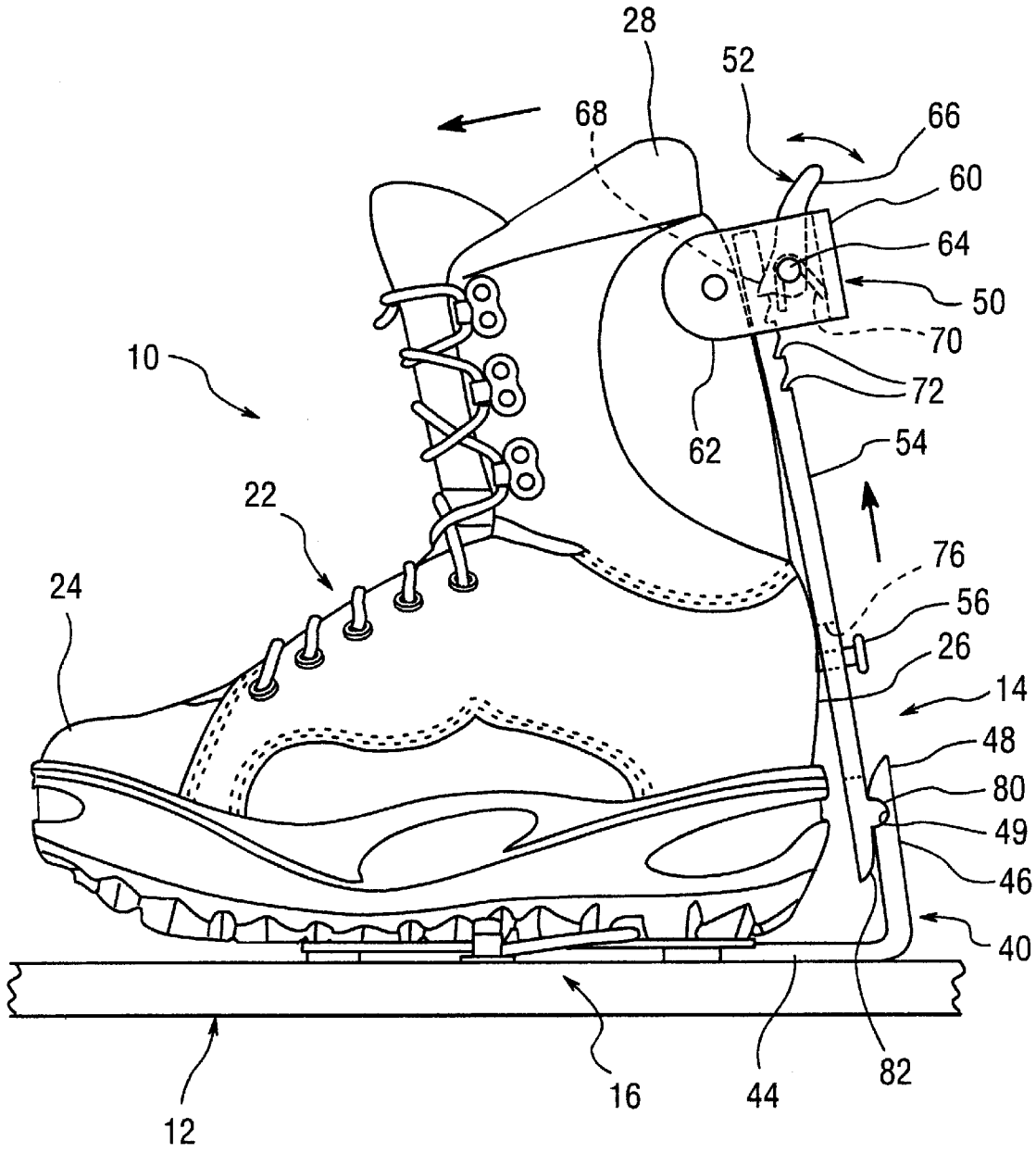
FIG. 7 is a side elevational view of the snowboard boot and the snowboard illustrated in FIGS. 1, 2, 5 and 6 with the active highback system of the present invention bending the snowboard boot to a further leaning position.

As seen in FIGS. 1, 2 and 5–7, active highback system 14 basically includes an activating member 40 coupled with binding 16, and an adjustable highback support 42 coupled to snowboard boot 10. The inclination or amount of lean of snowboard boot 10 is automatically adjusted between a walking position and a riding position simply by stepping into and out of binding 16. In other words, when the rider steps into binding 16, highback support 42 engages activating member 40 to cause the leg portion 28 of the snowboard boot 10 to lean forward towards the toe portion 24 as seen in FIGS. 6 and 7. When the snowboard boot 10 is released from binding 16, activating member 40 and highback support 42 separate to allow leg portion 28 to flex without requiring any adjustment by the rider. Accordingly, active highback system 14 provides a quick and simple boot adjustment without the need of any complicated locking mechanisms.

As best seen in FIGS. 2 and 5, activating member 40 basically includes a first part 44 that is adjustably coupled to binding 16, and a second part 46 extending upwardly from first part 44 for engagement with highback support 42. First part 44 should be adjustable relative to binding 16 to accommodate various sizes of snowboard boots. Any type of adjustment mechanism can be utilized. While activating member 40 is illustrated as being adjustably coupled to the binding 16 by a slot and bolt arrangement in FIG. 2, it will be apparent to those skilled in the art from this disclosure that activating member 40 can be coupled to the snowboard 12 if needed and/or desired.

Second part 46 has a free end with a coupling member 48 formed thereon. Coupling member 48 is designed to engage a portion of highback support 42, as explained below, via a quick and simple snap-type of fit. Activating member 40 and coupling member 48 form a snap-type of lock arrangement which holds the bottom end of highback support 42 in a fixed position, and forces leg portion 28 to a forward leaning position. In the illustrated embodiment, coupling member 48 has a transverse recess or groove that mates with a complimentary part of highback support 42.

Preferably, first and second parts 44 and 46 are constructed of a rigid material such as a hard non-flexible, metallic material such as steel. Of course, other rigid materials can be used such as a hard plastic material.

Support 42 basically includes a U-shaped bracket 50 coupled to leg portion 28 of snowboard boot 10, a lever 52 pivotally coupled to bracket 50, and a substantially rigid support member 54 coupled to the leg portion 28 of upper portion 22 via pin 56.

Bracket 50 is a U-shaped member constructed of a hard rigid material such as steel. Bracket 50 has a center section 60 and a pair of end sections 62 extending substantially perpendicular from center section 60. Each of the end sections 62 is fastened to leg portion 28 of snowboard boot 10 via a fastener such as a rivet. A pivot pin 64 connects end sections 62 together. Lever 52 is pivotally coupled on pivot pin 64.

Lever 52 preferably has a release portion 66 and a tooth portion 68 that engages support member 54 to hold support member 54 in a set position. Lever 52 is urged against support member 54 by a biasing member 70. Biasing member 70 is preferably a torsion-type spring. Biasing member 70 has its coiled portion mounted on pivot pin 64. A first end of the spring engages center section 60 of bracket 50, while a second end of spring engages a part of lever 52. Thus, lever 52 is normally biased against support member 54 to lock it in one of a plurality of predetermined leaning positions.

Support member 54 is preferably an elongated member having a first end with a plurality of notches or teeth 72, and a second end with a coupling member 74. A longitudinally extending slot 76 is formed between teeth 72 and coupling member 74. Slot 76 receives pin 56 therein such that pin 56 slidably retains support member 54 on the rear side of heel portion 26 and leg portion 28. Accordingly, support member 54 can be moved vertically along the rear of snowboard boot 10. The vertical movement of support member 54 relative to snowboard boot 10 is controlled by lever 52 which selectively engages one of the notches or teeth 72. While only four teeth 72 are illustrated, it will be apparent to those skilled in the art that more or fewer teeth can be utilized depending upon the amount of adjustment needed and/or desired.

Lever 52 and notches or teeth 72 of support member 54 form an adjusting mechanism to provide a plurality of leaning positions. This adjusting mechanism is a one-way clutch. Preferably, the one-way clutch is a ratchet-type of adjusting mechanism that prevents support member 54 from freely moving upwardly passed lever 52 but allows support member 54 to move freely downwardly passed lever 52. More specifically, the rider can automatically increase the amount of forward lean by merely leaning forward when the snowboard boot 10 is properly engaged in binding 16 and coupling member 74 is engaged with coupling member 48 of activating member 40. More specifically, by leaning forward in snowboard boot 10, the rider causes leg portion 28 to pull bracket 50 and lever 52 upwardly along, support member 54. This relative movement causes lever 52 to be biased against the force of biasing member 70 and engaged the next notch or tooth 72. Support member 54 is prevented from moving upwardly with bracket 50 and lever 52 because coupling member 48 is coupled with activating member 40.

Coupling member 74 is illustrated in the form of a protrusion 80 and a curved ramping surface 82. Curved ramping surface 82 is designed to engage a complimentary ramping surface 49 of activating member 40 during engagement of snowboard boot 10 with binding 16. Once the snowboard boot 10 is completely inserted into binding 16, protrusion 80 of coupling member 74 will engage the recess of activating member 40. This latching or coupling causes the stiff rigid support member 54 to apply a bending force on leg portion 28. Thus, leg portion 28 is bent or leaned forward towards the toe portion 24.

If the rider desires less lean, the rider merely pivots lever 52 against the force of biasing member 70 such that its tooth portion 68 becomes disengaged from teeth 72 of support member 54. Then the rider merely needs to lean back until the desired amount of lean is obtained and release the lever 52 so that the tooth portion 68 re-engages one of the notches or teeth 72 of the support member.

ALTERNATE EMBODIMENT

Figure 8:
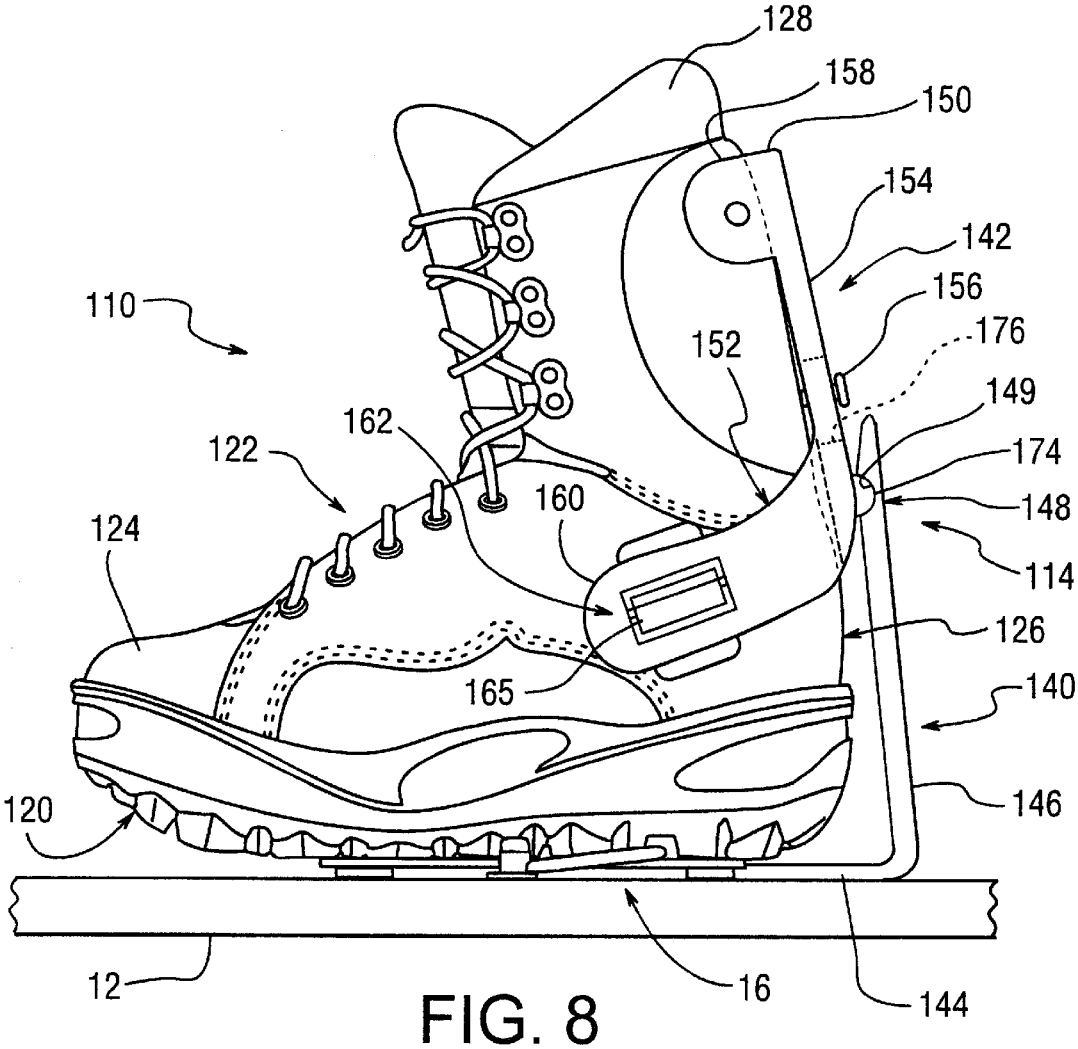
FIG. 8 is a side elevational view of an alternate snowboard boot mounted on a snowboard with an active highback system in accordance with another embodiment of the present invention.
Figure 9:
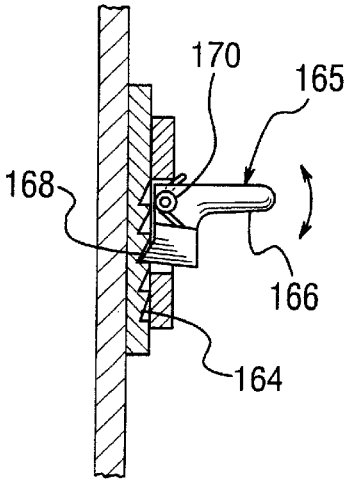
FIG. 9 is a partial cross-sectional view of a portion of the active highback system for the snowboard boot illustrated in FIG. 8.
Figure 10:
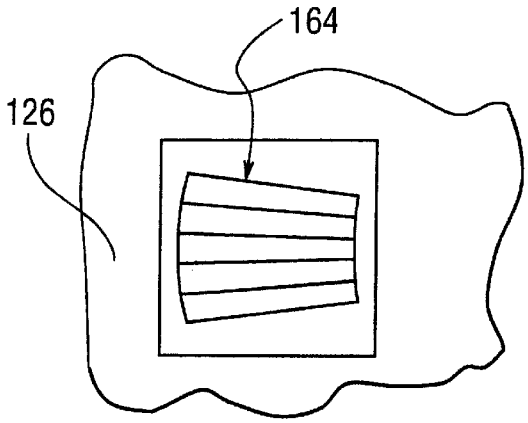
FIG. 10 is a partial side elevational view of a portion of the snowboard boot mounted on a snowboard illustrated in FIGS. 8 and 9.

As seen in FIGS. 8–10, a snowboard boot 110 is illustrated with an active highback system 114 coupled thereto in accordance with an alternate embodiment of the present invention. Active highback system 114 is designed to allow the snowboard boot 110 to be automatically adjusted from a walking position to a riding position upon snowboard boot 10 being attached to snowboard 12. More specifically, active highback system 114 does not constrain the flexibility of snowboard boot 110 making it possible for the snowboard rider to walk easily when the snowboard boot 110 is not coupled to snowboard 12. When the rider steps into the binding 16 of the snowboard 12, active highback system 114 automatically causes the snowboard boot 110 to lean forward. In other words, the active highback system 114 engages the rear of the snowboard boot 10 to provide a rigid surface that holds the snowboard boot 110 in a forward lean position. Moreover, active highback system 114 allows the rider to automatically increase the amount of forward lean of the snowboard boot 110 by merely leaning forward.

Snowboard boot 110 basically includes a sole portion 120 and an upper portion 122 that are fixedly coupled together. Typically, the sole portion 120 is made of a stiff rubber-like material. The upper portion 122, on the other hand, can be made from a variety of materials such as plastic materials, leather and/or synthetic leather materials. Upper portion 122 should be somewhat flexible so that active highback system 114 can apply a forward leaning force thereto. Upper portion 122 basically includes a toe portion 124, a heel portion 126 and a leg portion 128. These three portions 124, 126 and 128 form a boot body that is coupled to sole portion 120.

Sole portion 120 is preferably has front and rear engagement members (not shown) for engagement with binding 16 of snowboard 12 in a conventional manner as shown in the first embodiment.

As seen in FIG. 8, active highback system 114 basically includes an activating member 140 and an adjustable highback support 142. Activating member 140 is either coupled to binding 16 as shown or to snowboard 12. Highback support 142 is adjustably coupled to snowboard boot 110 to adjust the amount of inclination or lean of leg portion 128 of snowboard boot 110. Highback support 142 can be either permanently secured to snowboard boot 110 or removably coupled to snowboard boot 110. In other words, highback support 142 can be sold as an add on accessory to the snowboard boot or as a permanent part of the snowboard boot.

The inclination or amount of lean of snowboard boot 110 is automatically adjusted between a walking position and a riding position simply by stepping into and out of binding 16. In other words, when the rider steps into binding 16, highback support 142 engages activating member 140 to cause the leg portion 128 of the snowboard boot 110 to lean forward towards the toe portion 124. When the snowboard boot 110 is released from binding 16, activating member 140 and highback support 142 separate to allow leg portion 128 to flex without requiring any adjustment by the rider. Accordingly, active highback system 114 provides a quick and simple boot adjustment without the need of any complicated locking mechanisms.

Activating member 40 basically includes a first part 144 that is adjustably coupled to binding 16, and a second part 146 extending upwardly from first part 144 for engagement with highback support 142. First part 144 should be adjustable relative to binding 16 to accommodate various sizes of snowboard boots.

Second part 146 has a free end with a coupling member 148 formed thereon. Coupling member 148 is designed to engage a portion of highback support 142, as explained below, via a quick and simple snap-type of fit. Coupling member 148 is formed as a recess 149 in the illustrated embodiment. Activating member 140 and coupling member 148 form a snap-type of lock arrangement which holds the bottom end of highback support 142 in a fixed position, and forces leg portion 128 to a forward leaning position. In the illustrated embodiment, coupling member 148 has a transverse recess or groove that mates with a complimentary part of highback support 142.

Preferably, first and second parts 144 and 146 are integrally formed as a one-piece, unitary member such as from a rigid material. For example, a hard non-flexible, metallic material such as steel can be used to form activating member 140. Of course, other rigid materials can be used such as a hard plastic material.

Support 142 basically includes an upper U-shaped portion 150, a lower U-shaped portion 152 and a substantially rigid support member 154 extending between U-shaped portions 150 and 152. Preferably, upper U-shaped portion 150, lower U-shaped portion 152 and support member 154 are integrally formed as a one-piece, unitary member such as from a rigid material. Upper U-shaped portion 150 is coupled to leg portion 128 of snowboard boot 110, while lower U-shaped portion 152 is coupled to heel portion 126 of snowboard boot 10. Support member 154 extends along the rear surface of leg portion 128 and is slidably coupled thereto via pin 156.

Upper U-shaped portion 150 has a pair of end sections 158 extending from the upper portion of support member 154. Each of the end sections 158 is fastened to leg portion 128 of snowboard boot 110 via a fastener such as a rivet. Of course, the end sections 158 can be releasably fastened to leg portion 128 of snowboard boot 110, if needed and/or desired.

Lower U-shaped portion 152 has a pair of end sections 160 extending from the lower portion of support member 154. Each of the end sections 160 is coupled to leg portion 128 of snowboard boot 110 via an adjusting mechanism 162. Each adjusting mechanism 162 has a set of ratchet teeth 164 fastened to the heel portion 126 and a lever 165 pivotally coupled to one of the end sections 160 of support 142.

Lever 165 preferably has a release portion or handle 166 and a tooth portion 168 that engages ratchet teeth 164 to hold support member 154 in a set position. A biasing member 170 urges lever 165 against ratchet teeth 164. Biasing member 170 is preferably a torsion-type spring. Biasing member 170 has its coiled portion mounted on pivot pin 171. A first end of the spring 170 engages end section 160 of support 142, while a second end of spring 170 engages a part of lever 165. Thus, lever 165 is normally biased against ratchet teeth 164 to lock support 142 in one of a plurality of predetermined leaning positions. Ratchet teeth 164 are angled as a trapezoid with smaller end being closer to the rear of boot 1 10. These ratchet teeth 164 allow the tooth portion 168 of lever 165 to move therein to allow for pivoting movement of the support 142 relative to the boot 110. Thus, when activating member 140 is disengaged from support 142, the leg portion 128 can flex so the rider can walk.

Support member 154 is preferably an elongated member having an upper end with upper U-shaped portion 150 coupled thereto and a lower end with lower U-shaped portion 152 coupled thereto. Lower U-shaped portion 152 of support member 154 has a coupling member 174 extending outwardly therefrom. A longitudinally extending slot 176 is formed between upper U-shaped portion 150 and lower U-shaped portion 152. Slot 176 receives pin 156 therein such that pin 156 slidably retains support member 154 on the rear side of leg portion 128. Accordingly, support member 154 can be moved vertically along the rear of snowboard boot 110. The vertical movement of support member 154 relative to snowboard boot 110 is limited by adjusting mechanism 162.

Lever 165 and ratchet teeth 164 form an adjusting mechanism 162 to provide a plurality of leaning positions. Each adjusting mechanism 162 is a one-way clutch. Preferably, the one-way clutch is a ratchet-type of adjusting mechanism that prevents leg portion 128 from freely moving rearwardly, but allows leg portion 128 to move freely forwardly. More specifically, the rider can automatically increase the amount of forward lean by merely leaning forward when the snowboard boot 110 is properly engaged in binding 16 and coupling member 174 is engaged with coupling member 148 of activating member 140. More specifically, by leaning forward in snowboard boot 110, the rider causes leg portion 128 to pull support 142 forward. This forward movement results in a pivoting action between activating member 140 and support 142. This relative pivoting movement causes lever 165 to be biased against the force of biasing member 170 and engaged the next notch or tooth of ratchet teeth 164.

Coupling member 174 is illustrated in the form of a protrusion. Once the snowboard boot 110 is completely inserted into binding 16, protrusion or coupling member 174 will engage the recess 149 of activating member 140. This latching or coupling causes the stiff rigid support member 154 to apply a bending force on leg portion 128. Thus, leg portion 128 is bent or leaned forward towards the toe portion 124.

If the rider desires less lean, the rider merely pivots lever 165 against the force of biasing member 170 such that its tooth portion 168 becomes disengaged from teeth 164 of support member 154. Then, the rider merely needs to lean back until the desired amount of lean is obtained and release the lever 165 so that the tooth portion 168 re-engages one of the notches or teeth of ratchet teeth 164.

MANUAL EMBODIMENT OF FIG. 11

Figure 11:
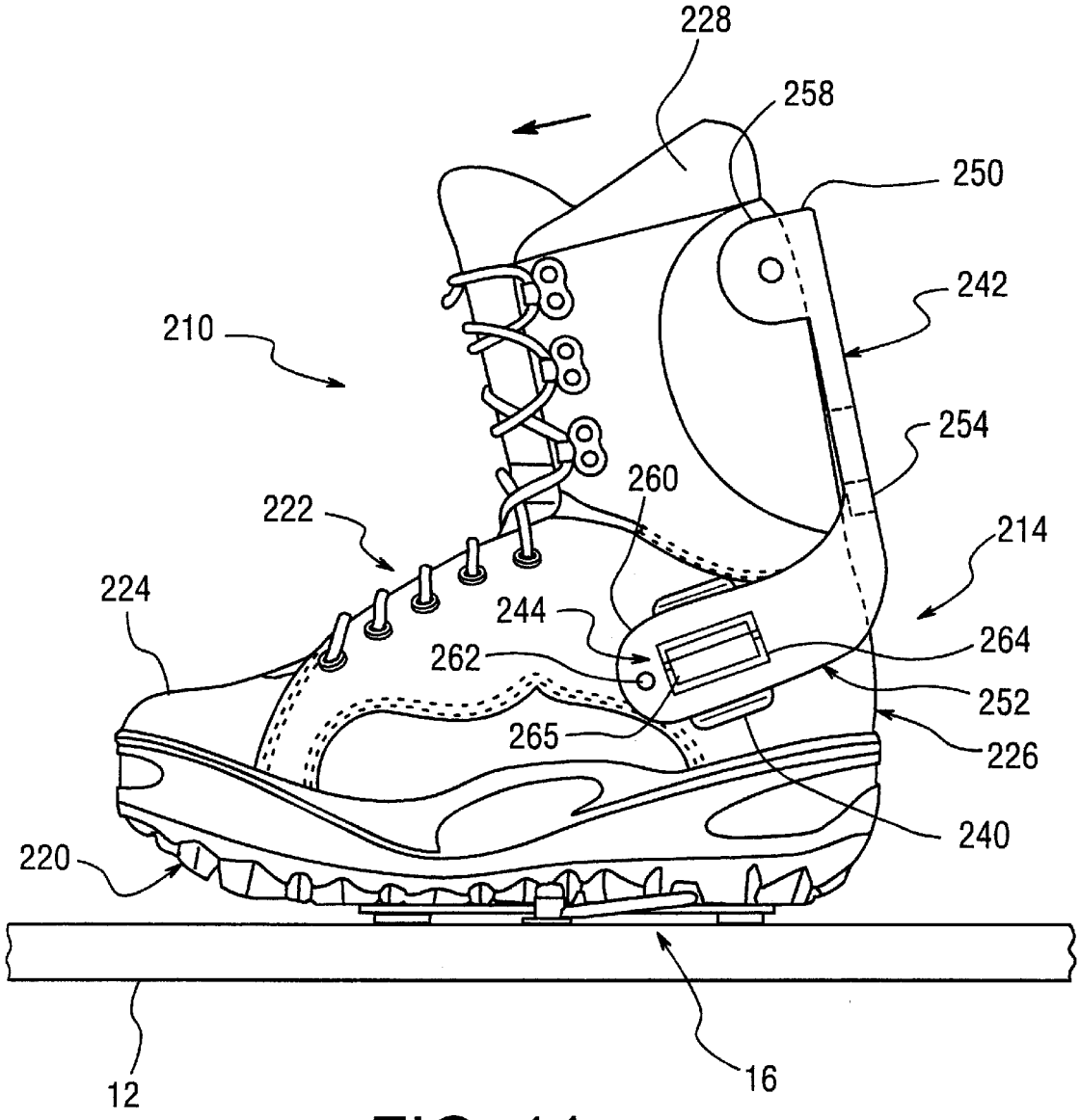
FIG. 11 is a side elevational view of an alternate snowboard boot mounted on a snowboard with a highback system in accordance with another embodiment of the present invention.

As seen in FIG. 11, a snowboard boot 210 is illustrated with a highback system 214 coupled thereto in accordance with another embodiment of the present invention. Similar to the first and second embodiments, highback system 214 allows the rider to automatically increase the amount of forward lean by merely leaning forward in snowboard boot 210. However, highback system differs from the prior embodiments in that it does not utilize an activating member 40 or 140. Rather, highback system 214 requires manual operation to move the boot from a riding mode to a walking mode. In view of the similarities between this embodiment and the prior embodiments, this embodiment will not be discussed or illustrated in detail herein.

Snowboard boot 210 basically includes a sole portion 220 and an upper portion 222 that are fixedly coupled together. Typically, the sole portion 220 is made of a stiff rubber-like material. The upper portion 222, on the other hand, can be made from a variety of materials such as plastic materials, leather and/or synthetic leather materials. Upper portion 222 should be somewhat flexible so that active highback system 214 can apply a forward leaning force thereto. Upper portion 222 basically includes a toe portion 224, a heel portion 226 and a leg portion 228. These three portions 224, 226 and 228 form a boot body that is coupled to sole portion 220.

Sole portion 220 is preferably has front and rear engagement members (not shown) for engagement with binding 16 of snowboard 12 in a conventional manner as shown in the first embodiment.

Highback system 214 is adjustably coupled to snowboard boot 210 to adjust the amount of inclination or lean of leg portion 228 of snowboard boot 210. Highback system 214 can be either permanently secured to snowboard boot 210 or removably coupled to snowboard boot 210. In other words, highback system 214 can be sold as an add on accessory to the snowboard boot or as a permanent part of the snowboard boot.

Highback system 214 includes a pair of boot attachment portions 240, a support 242 and a pair adjusting mechanism 244 located between boot attachment portions 240 and support 242. Boot attachment portions 240 are fixedly coupled to the sides of the boots along heel portion 226. Boot attachment portions 240 are preferably part of a solid heel cup with a portion of each adjusting mechanism 244 formed thereon. Support 242 extends along heel portion 226 and leg portion 228.

Support 242 basically includes an upper U-shaped portion or part 250, a lower U-shaped portion or part 252 and a substantially rigid support portion 254 extending between U-shaped portions 250 and 252. Preferably, upper U-shaped portion 250, lower U-shaped portion 252 and support portion 254 are integrally formed as a one-piece, unitary member such as from a rigid material. Upper U-shaped portion 250 is coupled to leg portion 228 of snowboard boot 210, while lower U-shaped portion 252 is coupled to heel portion 226 of snowboard boot 210. Support portion 254 extends along the rear surface of leg portion 228.

Upper U-shaped portion 250 has a pair of end sections 258 extending from the upper portion of support portion 254. Each of the end sections 258 is fastened to leg portion 228 of snowboard boot 210 via a fastener such as a rivet. Of course, the end sections 258 can be releasably fastened to leg portion 228 of snowboard boot 210, if needed and/or desired.

Lower U-shaped portion 252 has a pair of end sections 260 extending from the lower portion of support portion 254. Each of the end sections 260 is pivotally coupled to leg portion 228 of snowboard boot 210 via a pin 262. Each of the end sections 260 also has one of the adjusting mechanism 244 coupled thereto.

Each adjusting mechanism 244 has a set of ratchet teeth 264 fastened to the heel portion 226 via boot attachment portion 240 and a lever 265 pivotally coupled to one of the end sections 260 of support 242.

Lever 265 preferably has a release portion or handle and a tooth portion that engages ratchet teeth 264 to hold support portion 254 in a set forward leaning position. A biasing member urges lever 265 against ratchet teeth 264. The biasing member is preferably a torsion-type spring. Thus, lever 265 is normally biased against ratchet teeth 264 to lock support 242 in one of a plurality of predetermined leaning positions.

Levers 265 of support 242 and ratchet teeth 264 of each boot attachment portion 240 form adjusting mechanisms 244 to provide a plurality of leaning positions. This adjusting mechanisms 244 are one-way clutches. Preferably, the one-way clutches are ratchet-type of adjusting mechanisms that prevent leg portion 228 from freely moving rearwardly, but allows leg portion 228 to move freely forwardly. More specifically, the rider can automatically increase the amount of forward lean by merely leaning forward. More specifically, by leaning forward in snowboard boot 210, the rider causes leg portion 228 to pull support 242 forward. This forward movement results in a pivoting action between the boot attachment portions 240 and support 242. This relative pivoting movement causes lever 265 to be biased against the force of the biasing member and engaged the next tooth of ratchet teeth 264.

If the rider desires less lean, the rider merely pivots lever 265 against the force of the biasing member such that its tooth portion becomes disengaged from teeth 264 of support portion 254. Then, the rider merely needs to lean back until the desired amount of lean is obtained and release the lever 265 so that the tooth portion re-engages one of the notches or teeth of ratchet teeth 264.

MANUAL EMBODIMENT OF FIG. 12

Figure 12:
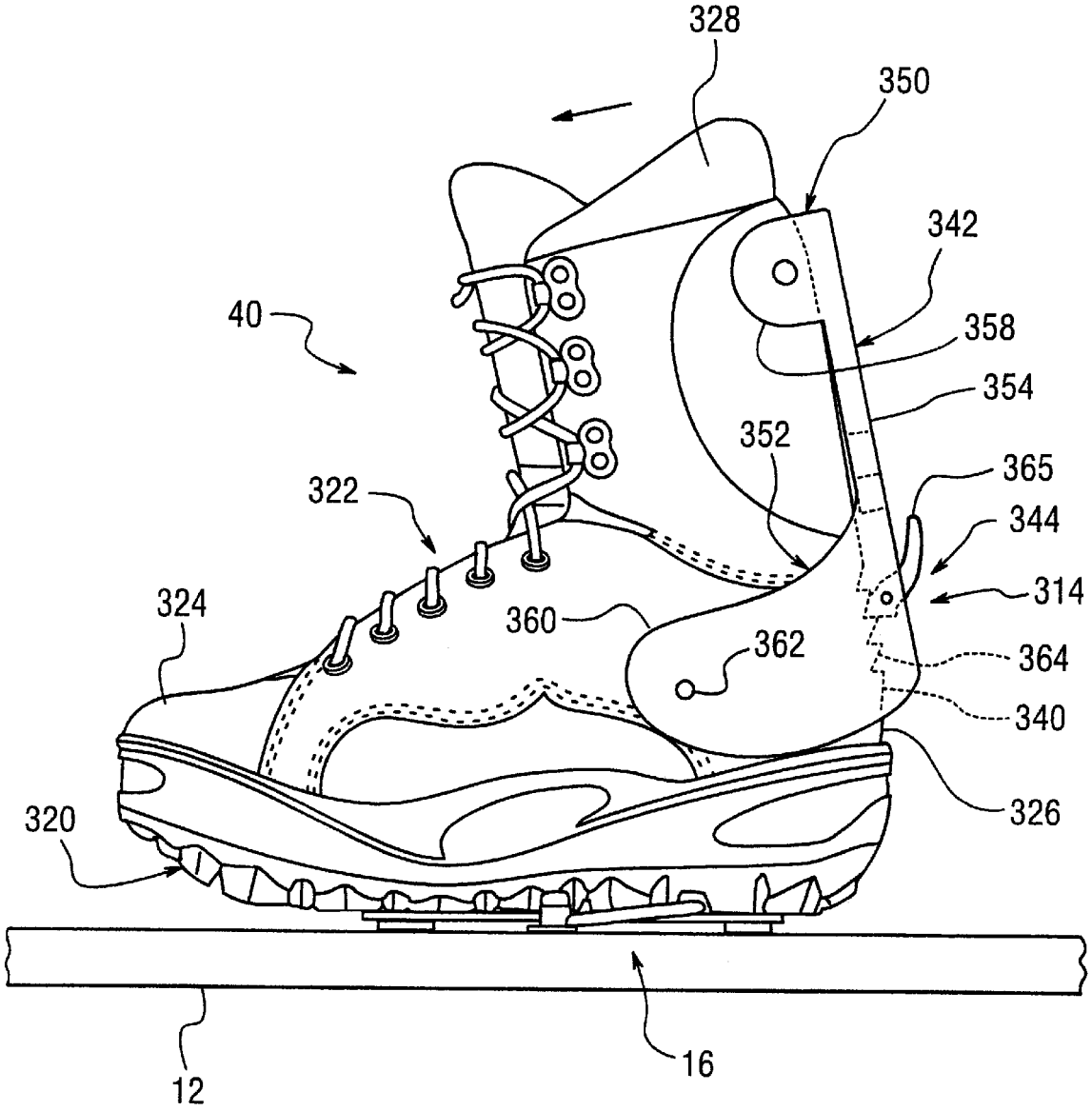
FIG. 12 is a side elevational view of an alternate snowboard boot mounted on a snowboard with a highback system in accordance with another embodiment of the present invention.

As seen in FIG. 12, a snowboard boot 310 is illustrated with a highback system coupled thereto in accordance with another embodiment of the present invention. Similar to the first and second embodiments, highback system 314 allows the rider to automatically increase the amount of forward lean by merely leaning forward in snowboard boot 310. However, highback system differs from the prior embodiments in that it does not utilize an activating member 40 or 140. Rather, highback system 314 requires manual operation to move the boot from a riding mode to a walking mode as in the third embodiment. In view of the similarities between this embodiment and the prior embodiments, this embodiment will not be discussed or illustrated in detail herein.

Snowboard boot 310 basically includes a sole portion 320 and an upper portion 322 that are fixedly coupled together. Typically, the sole portion 320 is made of a stiff rubber-like material. The upper portion 322, on the other hand, can be made from a variety of materials such as plastic materials, leather and/or synthetic leather materials. Upper portion 322 should be somewhat flexible so that active highback system 314 can apply a forward leaning force thereto. Upper portion 322 basically includes a toe portion 324, a heel portion 326 and a leg portion 328. These three portions 324, 326 and 328 form a boot body that is coupled to sole portion 320.

Sole portion 320 is preferably has front and rear engagement members (not shown) for engagement with binding 16 of snowboard 12 in a conventional manner as shown in the first embodiment.

Highback system 314 is adjustably coupled to snowboard boot 310 to adjust the amount of inclination or lean of leg a portion 328 of snowboard boot 310. Highback system 314 can be either permanently secured to snowboard boot 310 or removably coupled to snowboard boot 310. In other words, highback system 314 can be sold as an add on accessory to the snowboard boot or as a permanent part of the snowboard boot.

Highback system 314 includes a boot attachment portion 340, support 342 and an adjusting mechanism 344 located between boot attachment portion 340 and support 342. Boot attachment portion 340 is fixedly coupled to the rear of heel portion 326. Boot attachment portion 340 is preferably a solid heel cup with part of adjusting mechanism 344 formed thereon. Support 342 extends along heel portion 326 and leg portion 328.

Support 342 basically includes an upper U-shaped portion or part 350, a lower U-shaped portion or part 352 and a substantially rigid support portion 354 extending between U-shaped portions 350 and 352. Preferably, upper U-shaped portion 350, lower U-shaped portion 352 and support portion 354 are integrally formed as a one-piece, unitary member such as from a rigid material. Upper U-shaped portion 350 is coupled to leg portion 328 of snowboard boot 310, while lower U-shaped portion 352 is coupled to heel portion 326 of snowboard boot 310. Support portion 354 extends along the rear surface of leg portion 328.

Upper U-shaped portion 350 has a pair of end sections 358 extending from the upper portion of support portion 354. Each of the end sections 358 is fastened to leg portion 328 of snowboard boot 310 via a fastener such as a rivet. Of course, the end sections 358 can be releasably fastened to leg portion 328 of snowboard boot 310, if needed and/or desired.

Lower U-shaped portion 352 has a pair of end sections 360 extending from the lower portion of support portion 354. Each of the end sections 360 is pivotally coupled to leg portion 328 of snowboard boot 310 via a pin 362.

Adjusting mechanism 344 has a set of ratchet teeth 364 formed on the solid heel cup of boot attachment portion 340 and a lever 365 pivotally coupled to support 342. Lever 365 preferably has a release portion or handle and a tooth portion that engages ratchet teeth 364 to hold support portion 354 in a set forward leaning position. A biasing member urges lever 365 against ratchet teeth 364. The biasing member is preferably a torsion-type spring. Thus, lever 365 is normally biased against ratchet teeth 364 to lock support 342 in one of a plurality of predetermined leaning positions.

Levers 365 of support 342 and ratchet teeth 364 of boot attachment portion 340 form adjusting mechanism 344 to provide a plurality of leaning positions. This adjusting mechanism 344 is a one-way clutch. Preferably, the one-way clutch is a ratchet-type of adjusting mechanism that prevents leg portion 328 from freely moving rearwardly, but allows leg portion 328 to move freely forwardly. More specifically, the rider can automatically increase the amount of forward lean by merely leaning forward. More specifically, by leaning forward in snowboard boot 310, the rider causes leg portion 328 to pull support 342 forward. This forward movement results in a pivoting action between the boot attachment portion 340 and support 342. This relative pivoting movement causes lever 365 to be biased against the force of the biasing member and engaged the next tooth of ratchet teeth 364.

If the rider desires less lean, the rider merely pivots lever 365 against the force of the biasing member such that its tooth portion becomes disengaged from teeth 364 of support portion 354. Then, the rider merely needs to lean back until the desired amount of lean is obtained and release the lever 365 so that the tooth portion re-engages one of the notches or teeth of ratchet teeth 364.

While several embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. An active highback system for a snowboard boot, comprising:

a boot attachment portion adapted to be fixedly coupled to the snowboard boot;

a substantially rigid support portion movably coupled to said boot attachment portion to apply a compression force to a leg portion of the boot in a direction extending generally from a heel portion of the boot towards a toe portion of the boot, said support portion including a first U-shaped part formed on an upper end of said support portion to engage the leg portion of the boot and a second U-shaped part formed on a lower end of said support portion to engage the heel portion of the boot, said first and second U-shaped parts being pivotally attached to the snowboard boot; and an adjusting mechanism having at least one ratchet mechanism coupled between said boot and said support portion to vary a forward lean angle of said support portion relative to said boot, said ratchet mechanism forming a one-way clutch that permits said support portion to selectively move from a first position to a more forward leaning position relative to said boot.

2. An active highback system as set forth in claim 1, wherein said ratchet mechanism includes a release lever to allow said support portion to move to a less forward leaning position.

3. An active highback system as set forth in claim 1, further comprising said release lever is pivotally mounted on said support portion that engages teeth formed on said boot.

4. An active highback system as set forth in claim 1, wherein said support portion includes an elongated plate located between said first and second U-shaped parts and adapted to extend along a rear portion of the leg portion of the boot.

5. An active highback system as set forth in claim 1, wherein said one-way clutch is formed between said second U-shaped part and said boot attachment portion.

6. An active highback system as set forth in claim 5, wherein said one-way clutch includes a pair of said ratchet mechanisms located on opposite sides of the boot.

7. A snowboard boot, comprising:

a boot body having a sole portion, a toe portion, a heel portion and a leg portion, said leg portion being constructed of a flexible first material; and an active highback support movably coupled to said boot body to apply a compression force to said leg portion in a direction generally extending from said heel portion towards said toe portion, said active highback support including a boot attachment portion fixedly coupled to said boot body, a substantially rigid support portion movably coupled to said boot attachment portion to apply a compression force to said leg portion of said boot body in a direction extending generally from said heel portion of said boot body towards said toe portion of said boot body, said support portion including a first U-shaped part formed on an upper end of said support portion to engage said leg portion of said boot body and a second U-shaped part formed on a lower end of said support portion to engage said heel portion of said boot body, said first and second U-shaped parts being pivotally attached to said boot body and an adjusting mechanism having at least one ratchet mechanism coupled between said boot body and said support portion to vary a forward lean angle of said support portion relative to said boot body, said ratchet mechanism forming a one-way clutch that permits said support portion to selectively move from a first position to a more forward leaning position.

8. A snowboard boot as set forth in claim 7, wherein said support portion and said adjusting mechanism are configured to be permanently fixed to said leg portion of said boot body.

9. A snowboard boot as set forth in claim 5, wherein said ratchet adjusting mechanism includes a release lever to allow said support portion to move to a less forward leaning position.

10. A snowboard boot as set forth in claim 9, wherein said release lever is pivotally mounted on said support portion that engages teeth formed on said boot body.

11. A snowboard boot as set forth in claim 7, wherein said support portion includes an elongated plate located between said first and second U-shaped parts and extending along a rear portion of said leg portion of said boot body.

12. A snowboard boot as set forth in claim 7, wherein said one-way clutch is formed between said second U-shaped part and said boot attachment portion.

13. A snowboard boot as set forth in claim 12, wherein said one-way clutch includes a pair of said ratchet mechanisms located on opposite sides of the boot.

* * * * *